United States Patent [19]

McNeil

[11] Patent Number: 4,729,559

[45] Date of Patent: Mar. 8, 1988

[54] COMBINED AEROBIC AND ANAEROBIC EXERCISER

[76] Inventor: Ronald A. McNeil, P.O. Box 14165, Tallahassee, Fla. 32317

[21] Appl. No.: 794,736

[22] Filed: Nov. 4, 1985

[51] Int. Cl.[4] ..... A63B 21/00

[52] U.S. Cl. ..... 272/73; 272/130

[58] Field of Search ..... 272/73, 72, 130, 93, 272/136, 132; 128/25 R; D21/194

[56] References Cited

U.S. PATENT DOCUMENTS

| | | | |
|---|---|---|---|
| 2,453,771 | 11/1948 | White et al. | 128/25 R |
| 3,485,495 | 12/1969 | Gibbs | 272/73 |
| 3,940,128 | 2/1976 | Ragone | 272/73 |
| 3,966,201 | 6/1976 | Mester | 272/73 |
| 4,188,030 | 2/1980 | Hooper | 272/73 |
| 4,509,742 | 4/1985 | Cones | 272/73 |
| 4,602,781 | 7/1986 | La Marsh et al. | 272/73 |
| 4,625,963 | 12/1986 | Lancellotti | 272/73 |

FOREIGN PATENT DOCUMENTS

| | | | |
|---|---|---|---|
| 994823 | 8/1976 | Canada | 272/73 |
| 2548713 | 5/1976 | Fed. Rep. of Germany | 272/136 |
| 3402973 | 8/1985 | Fed. Rep. of Germany | 272/73 |
| 1072001 | 3/1954 | France | 272/73 |

OTHER PUBLICATIONS

The New Bruce Jenner TR750J, AMF Whitey-Physical Fitness Products for 1980.

Schwinn, "Air-Dyne" Machine, Brochure, 12-1982, Excelsior Fitness Co.

AMF Whitey-Physical Fitness Products for 1980, Received Nov. 1980, pp. 26-27.

*Primary Examiner*—Richard J. Apley

*Assistant Examiner*—S. R. Crow

*Attorney, Agent, or Firm*—Shlesinger, Arkwright & Garvey

[57] ABSTRACT

A combined anaerobic and aerobic exerciser has a ground supported frame with a forward end and a rearward end. The seat on which the user sits is adjustably mounted to the rearward end. A flywheel is rotatably mounted to the rearward end rearwardly of the seat. A pedal mechanism is operatively connected to the flywheel by means of a chain so that the flywheel will rotate when the pedals are operated by the user. First and second handle bars are pivotally mounted to the forward end and are adapted for independent pivoting about a common axis. Cylinder and piston assemblies are mounted between the frame and the lower ends of the handle bars in order to resist pivoting of the handle bars.

10 Claims, 4 Drawing Figures

COMBINED AEROBIC AND ANAEROBIC EXERCISER

BACKGROUND OF THE INVENTION

Exercise equipment can be classified primarily as equipment intended for aerobic exercise and equipment intended for anaerobic exercise. Aerobic exercise stimulates the action of the heart and lungs and the circulation of the blood. Anaerobic exercise, on the other hand, involves the conditioning or toning of muscles and muscle groups. Naturally, because of the repetitive nature of exercise, there is some overlap in the effects of each of these categories of exercise. For example, an exercise bicycle, which is an aerobic exerciser, also causes the leg muscles to be toned to some extent because of the continuous pedaling action. Anaerobic exercise equipment, for example free weights, will cause increased heart and lung action if the weights are sufficiently heavy or the exercise regime of sufficient duration. Neither of these categories of exercise is superior to the other and, in fact, a good exercise program normally involves both types.

Exercise equipment previosly was designed for the institutional user; for example, for use in a gym. Recently, however, there has been an ever increasing interest in home exercise equipment permitting the user to perform both aerobic and/or anaerobic exercise at home with the appropriate equipment.

Many individuals do not have sufficient space available in their home to outfit a gym. There has therefore been a need for exercise equipment which is capable of use for both anaerobic and aerobic exercise. For example, Brown, et al, U.S. Pat. No. 4,477,071, discloses an exercise device which is a rowing machine in one orientation (aerobic) and which simulates free weights in a second orientation (anaerobic).

An exercise bicycle is a well known piece of aerobic exercise equipment which many individuals have in their home. The anaerobic exercise ability of the exercise bicycle is, however, extremely limited and relates primarily to strengthening of the leg muscles. Attempts have been made to combine an exercise bicycle with upper body conditioning devices, for example, Hooper, U.S. Pat. No. 4,188,030, but these attempts have primarily involved cooperative interconnection of the pedals with movable handle bars. The cooperative motion causes the resistance means to rotate. Such devices are not totally satisfactory for a combined exerciser because the movement of the handle bars is functionally related to the pedaling operation so that both occur at essentially a uniform rate. Therefore, one desirous of performing more strenuous exercise for his upper body is not able to do so because the pedals rotate at that same rate. It is therefore important that a combined exerciser permit independent exercise of the upper body while allowing the aerobic exercise achieved through the pedaling operation to continue at its own separate rate.

OBJECTS AND SUMMARY OF THE INVENTION

The primary object of the disclosed invention is to provide a combined aerobic and anaerobic exerciser which permits the anaerobic upper body exercises to be performed at a rate and with a force which is independent of the aerobic exercise attributable to the pedaling operation.

The disclosed invention has a ground supported frame with a forward end portion and a rearward end portion. A seat upon which the user sits is adjustably mounted to the rearward end portion. A flywheel is rotatably mounted to the frame and pedals are operatively connected thereto through a chain drive mechanism to cause the flywheel to rotate and provide aerobic benefit. A pair of handle bars are pivotally mounted to the forward end and are adapted for independent pivoting motion about a common axis. Cylinder and piston assemblies operatively interconnect the frame with the lower ends of the handle bars and resist pivoting of the handle bars and thereby provide anaerobic benefit for the upper body.

The rearward portion of the frame includes a first tube which slideably receives a second tube which carries the seat at the distal end. The second tube has a plurality of longitudinally spaced apertures; in any one of which a pin is inserted for locking the seat at a desired elevation. A similar pin arrangement is used to connect the cylinders to the lower ends of the handle bars. In this way, the force required to cause pivoting may be adjusted.

The fly wheel is, preferably, chrome plated steel and has two (2) peripheral flanges between which a nylon webbed belt extends and which is trained about the flywheel. This belt provides resistance to rotation of the wheel and a control handle adjusts the tension of the belt as a means for adjusting the resistance to rotation.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
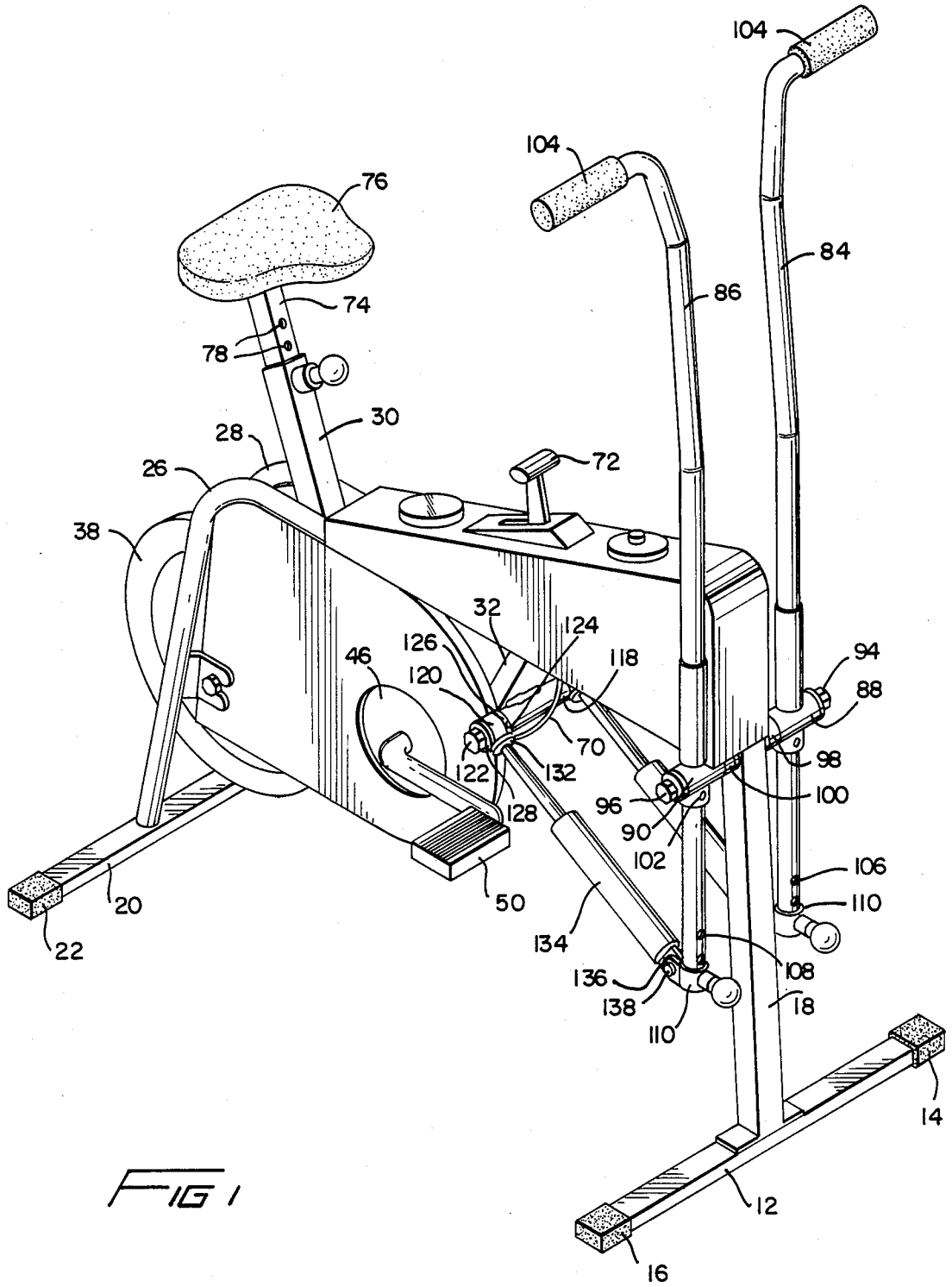
FIG. 1 is a perspective view of the exerciser of the invention.
Figure 2:
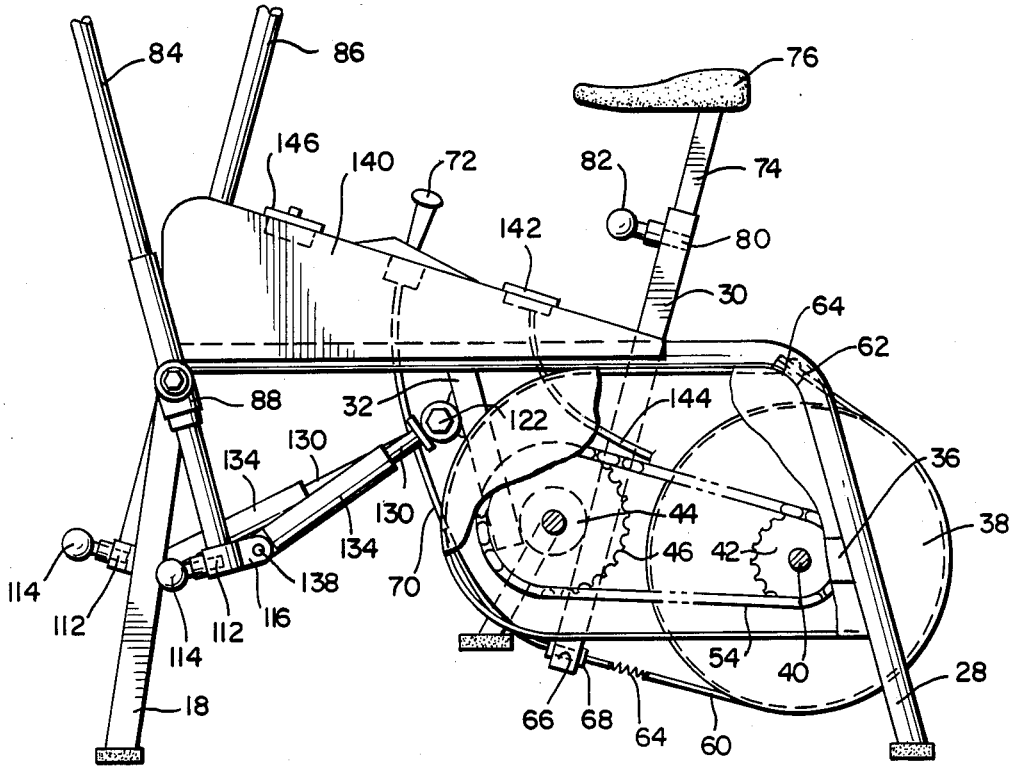
FIG. 2 is a fragment side elevational view with portions broken away.
Figure 3:
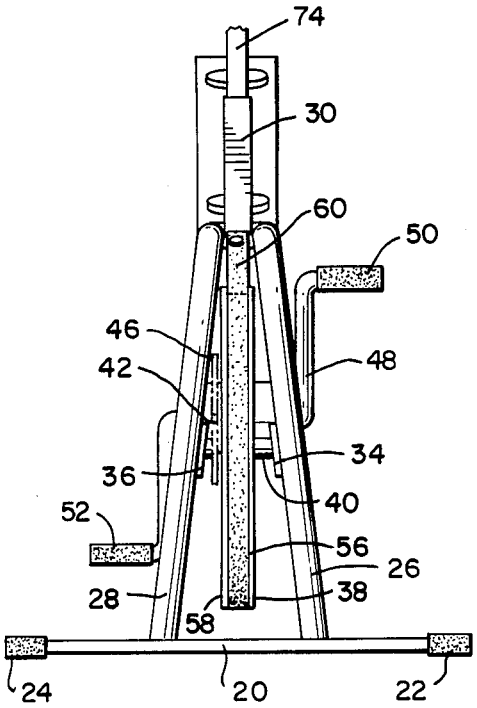
FIG. 3 is a rear fragmentary plan view thereof.

Combined exerciser 10, as best shown in FIGS. 1–3, is particularly useful for simultaneously yet independently performing both anaerobic and aerobic exercises.

Front ground engaging tubular support 12 has anti-skid caps 14 and 16 at the remote ends thereof. Center post 18 is secured to support 12 by bolts or welding, or the like, and extends generally perpendicular to the support 12. In this way, the center post 18 is vertically disposed and is, preferably, centrally disposed on support 12.

Rear support 20 is similar to front support 12 and has anti-skid caps 22 and 24 at the remote ends thereof. Tubular frame members 26 and 28 are generally L-shaped and have one end secured to rear support 20 by welding or the like and the other end thereof secured to the uppermost portion of center post 18. It can be noted in FIG. 3 that the frame members 26 and 28 are angularly disposed with respect to each other and form a truncated pyramid in plan. It can be noted in FIGS. 1 and 2 that the top segments of the frame members 26 and 28 extend generally horizontally and parallel with respect to the floor while the rear segments extend angularly with respect to support 20.

First tube 30 is secured to the top segments of frame members 26 and 28 and extends angularly with respect thereto. Brace 32 is likewise secured between and to the top segments of frame members 26 and 28 forwardly of tube 30. It can be noted in FIG. 2 that the brace 32 has a length substantially less than the length of the tube 30 and extends at an angle almost parallel with respect to the angularly disposed segments of the braces 26 and 28. Tube 30 and brace 32 converge toward the lower ends thereof for reasons explained below. Those skilled in the art will appreciate that the frame members 26 and 28 when connected to the center post 18 provide a frame having a three point suspension providing exceptionally good stability for the exerciser 10. Also, center post 18, brace 32 and tube 30 are longitudinally aligned for optimum weight distribution on the frame.

Brackets 34 and 36 are secured to and extend forwardly from frame members 26 and 28, respectively. Flywheel 38 is mounted on shaft 40 to which is rotatably disposed between brackets 34 and 36. Sprocket 42 is secured to flywheel 38 and rotatable therewith.

Housing 44 is secured by welding or the like to brace 32 and tube 30. Sprocket 46 is rotatably mounted to housing 44 and rotates a plane coincident with the plane in which sprocket 42 rotates. Pedal link 48 has a portion rotatably received in housing 44 and is secured to sprocket 46. Link 48 carries pedals 50 and 52 which the user operates to rotate sprocket 46. Chain 54 is trained about sprockets 42 and 46 so that the pedaling motion is transmitted to the flywheel 38 which is thereby rotated. Naturally, the weight of flywheel 38 has a certain amount of inertia which must be overcome and which therefore provides resistance for aerobic benefit.

The flywheel 38 has side flanges 56 and 58 between which webbed belt 60 extends. The belt 60 has end 62 secured to the frame members 26 and 28 by adjustable clamp 64 and the other end connected to spring 64. Tube 30 has an aperture 66 in the lower end thereof in which bushing 68 is received. Control cable 70 extends through bushing 68 and is secured to spring 64 and hence to belt 60. The other end of control cable 70 is connected to adjustable control lever 72. Pivoting of control lever 72 causes the control cable 70 to be moved inwardly and outwardly with respect to the bushing 68 so that the force exerted on the spring 64 may be selectively varied. Adjustment of the force exerted on spring 64 by pivoting of lever 70 causes the force exerted by belt 60 on flywheel 38 to be regulated. Regulation and adjustment of the force exerted by belt 60 on flywheel 38 therefore regulates the resistance to pedaling which must be overcome by the user. The greater the force, the greater the resistance. In this way, the resistance of the flywheel 38 to pedaling can be regulated so that the user can aerobically exercise at a comfortable level. This also permits the exerciser 10 to be used comfortably by more than one user.

As best shown in FIGS. 1 and 2, second tube 74 is slideably received within tube 30. The upper end of second tube 74 carries seat 76 upon which the user sits. Second tube 74 has a plurality of longitudinally spaced apertures 78 therein. Pin 80, as best shown in FIG. 2, is selectivly positionable in any one of the apertures 78 and serves to lock the tubes 74 and 30 with respect to each other. Knob 82 is connected to pin 80 and is adapted to be grasped and pulled outwardly, and thereby causes outward movement of the pin 80 in order to disengage the pin 80 from the aperture 78 in which it is positioned. In this way, the precise elevation of the seat 76 with respect to the pedals 50 and 52 may be adjusted so that the exercising will be comfortable.

Figure 4:
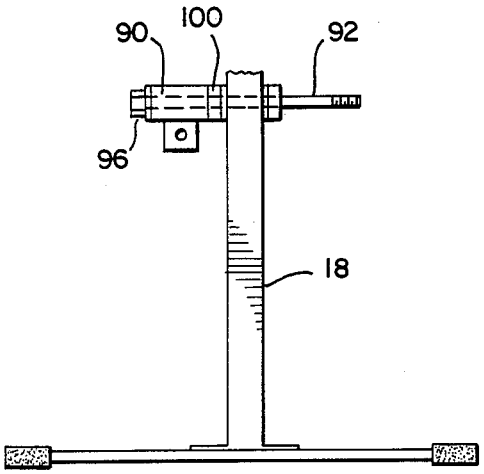
FIG. 4 is a fragmentary front plan view with portions removed for clarity.

As best shown in FIGS. 1 and 2, handle bars 84 and 86 are pivotally mounted to center post 18 by means of T-bushings 88 and 90, respectively, which are pivotally mounted to shaft 92, as best shown in FIG. 4. It can be noted in FIG. 4 that the shaft 92 extends outwardly from opposite sides of center post 18 and defines a common axis about which the handle bars 84 and 86 rotate. The shaft 92 has threaded portions at the remote ends thereof which receive nuts 94 and 96 which maintain the T-bushings 88 and 90, respectively, and thereby handle bars 84 and 86 in proper alignment. Preferably, spacers 98 and 100 are in contact with the opposite sides of center post 18 to maintain proper spacing of the T-bushings 88 and 90 with respect to the center post 18. Each of the T-connectors 88 and 90 preferably, has a set screw 102 which maintains proper elevation of the respective handle bar in its T-bushing. In this way, the handle bars 84 and 86 pivot in two parallel planes between which center post 18 is positioned.

Handle bars 84 and 86 each have a hand grip 104 which the user grasps and pushes or pulls to pivot the handle bars 84 and 86 about the common axis. Because the handle bars 84 and 86 are not locked together, either directly or indirectly, they are free to pivot independently of each other. The user is not thrown off balance by the need to simultaneously pivot the handle bars 84 and 86 in the same direction. This independent pivoting action permits the user to pivot the handle bars 84 and 86 in a way such that one handle bar is pivoting toward the user while the other is pivoting away from the user. Therefore, the user may remain seated upright on the seat 76. This also avoids the risk of back strain or the like which may occur if the user must operate the handle bars simultaneously.

As best shown in FIG. 1 longitudinally spaced apertures 106 and 108 are disposed in the lower end portions of the handle bars 84 and 86, respectively. Clamps 110 are slidably mounted on the lower end portions of the handle bars 84 and 86. Pins 112, as best shown in FIG. 2, are connected to knobs 114. The knobs 114 are adapted to be grasped by the user's hand in order to cause the knobs 114 and the attached pins 112 to be moved inwardly and outwardly with respect to the handle bars 84 and 86. In this way, pins 112 can be selectively positioned in one of the apertures 106 and 108, respectively, upon appropriate sliding of clamps 110 with respect to the handle bars. Pins 112 thereby lock the clamps 110 at a desired distance from the common axis defined by the shaft 92 in order to vary the moment arm of the handle bars 84 and 86. This has the effect of varying the force required to pivot the handle bars as will be further explained.

Clamps 110 each include a clevis member 116. The clevises 116 extend rearwardly from the clamps 110 and are positioned approximately 180° opposite knobs 114.

Shaft 118, as best shown in FIG. 1, is secured to brace 32 by welding or the like and extends outwardly from opposite sides of brace 32. Bushing 120 is pivotally mounted to shaft 118 by nut 122. Preferably, shaft 118 has shoulders 124 on opposite sides thereof which provide a stop for bushings 120 so that the bushings 120 are properly positioned thereon. Nylon spacer 126 is disposed between shoulder 124 and bushing 120 in order to minimize friction and to thereby permit easy pivoting of the bushing 20 about the shaft 124. A corresponding spacer 128 is also appropriately provided on the opposite side of bushing 120.

Bushing 120 is secured to piston 130 and has rubber bumper or shock absorber 132. Piston 130 is slidably received within hydraulic cylinder 134 in a well known manner. Cylinders 134 each have ear 136 which are pivotally secured to clevises 116 by bolts 138. In this way, the cylinder and piston assemblies are free to pivot about the shaft 124 and the bolts 138 during pivoting of the handle bars 84 and 86 about the common axis defined by shaft 92.

Preferably, housing 140 is mounted to the upper segments of frame members 26 and 28 and extends between tube 30 and center post 18. Lever 72 is mounted to housing 140 so as to be easily accessable to the user when seated on seat 76. Speedometer 142 is also positioned on the housing 140 and has a speedometer cable 144 which is operably connected to sprocket 42 in a manner known in the art. Timer 146 is located forwardly of lever 72.

OPERATION

Use of the exerciser 10 for simultaneous areobic and anaerobic exercising at separate exercise rates is possible because the flywheel 38 is not operably connected with the handle bars 84 and 86. Therefore, the user can pedal at one rate while pivoting the handle bars 84 and 86 at a separate rate. The user merely seats himself on seat 76, after the elevation of the seat has been properly adjusted by means of pin 80, and sets the control lever 72 for the desired tension of belt 60. Likewise, clamps 110 are appropriately spaced from the common axis defined by shaft 92 so that the resistance force exerted by the cylinders and pistons 130 and 134, respectively, are at the desired level. Those skilled in the art will appreciate that the greater the distance of the clamps 110 from the common axis of the shaft 92, then the greater the force required to cause pivoting of the handle bars 84 and 86 because of the increased moment arm.

Because of the independent pivoting nature of the handle bars 84 and 86, the user may remain seated upright with proper posture on the seat 76 while rotating the flywheel 38 through pedals 50 and 52. Simultaneously, the user may independently pivot the handle bars 84 and 86 toward and away from him to perform the anaerobic exercise. The exerciser 10 is uniquely designed to permit the user to remain upright because first one handle bar is pulled toward seat 76 while the other handle bar thereof is pushed away. This process is then repeated continuously, or not continuously as desired, in order to perform the anaerobic exercise.

Naturally, the exerciser 10 can be used as a conventional exercycle without the need for operating the handles 84 and 86. Similarly, the handle bars 84 and 86 can be operated without the need for pedaling. However, the device 10 is most efficiently utilized when the anaerobic exercise occurs simultaneously with the aerobic exercising and thereby maximizes the exercise benefit obtained. Because the handle bars pivot independent of the operation of the flywheel 38, the user can perform anaerobic exercising at one force and aerobic exercise at a different force level.

While this invention has been described as having a preferred design, it is understood that it is capable of further modifications uses and/or adaptations of the invention following in general the principle of the invention and including such departures from the present disclosure has come within known or customary practice in the art to which the invention pertains, and as may be applied to the central features hereinbefore set forth, and fall within the scope of the invention of the limits of the appended claims.

What I claim is:

1. A combined aerobic and anaerobic exerciser, comprising:

(a) a ground supported frame with a forward end portion, a rearward end portion and connecting means extending between said forward and rearward end portions forming upper and lower sections of said frame;

(b) said forward end portion including a vertically disposed center post;

(c) a seat adjustably secured to said rearward portion;

(d) first shaft means secured to said center post and extending from opposite sides thereof;

(e) first and second independently operable handle bar means whereby the user of said exerciser can selectively operate one of said first and second handle bar means without corresponding movement from the other of said handle bar means;

(f) said handle bar means including an upper end portion adapted to be grasped by a user's hand for pivoting the handle bar means and a lower end portion disposed below said shaft means;

(g) variable first resistance means including a first and second cylinder and piston means, each having one end pivotally secured to said second shaft means on said frame and the opposite end thereof pivotally secured to one of said lower end portions of said handle bar means;

(h) a second resistance means including flywheel means rotatably mounted to said lower section of said frame;

(i) pedal means rotatably mounted to said frame and operatively engaged with said flywheel means for rotating said flywheel means;

(j) said pedal means including a pedal housing having at least one pedal rotatably received therein;

(k) said first resistance means being disposed forward of said pedal housing;

(l) said second resistance means being disposed rearward of said pedal housing; and, (m) said first resistance means being operable independently of said second resistance means whereby the anaerobic upper body exercises associated with said first resistance means can be performed at a rate and with a force which is independent of the lower body aerobic exercises associated with said second resistance means.

2. The exerciser of claim 1, wherein:

(a) said rearward end portion including a first tube angularly disposed with respect to said center post;

(b) a second tube being slidably received in said first tube;

(c) a plurality of spaced apertures being disposed in said second tube;

(d) pin means being movably associated with said first tube and selectively positionable in one of said apertures for securing said second tube at a desired position with respect to said first tube; and (e) said seat being secured to an end of said second tube.

3. The exerciser of claim 2, wherein:
(a) clamp means being adjustably positioned on each of said lower end portions; and,
(b) said opposite ends being pivotally secured to said clamp means as a means for altering the resistance to pivoting of said handle bar means.
4. The exerciser of claim 3, wherein:
(a) each of said lower end portions having a plurality of spaced apertures therein; and,
(b) said clamp means including pin means selectively positionable in said apertures for locking said clamp means at a desired position relative to said shaft means.
5. The exerciser of claim 4, wherein:
(a) said rearward end portion including arcuate first and second frame members; and,
(b) said first tube being disposed between and secured to said frame members.
6. The exerciser of claim 4, wherein:
(a) said opposite ends being pivotally secured to said clamp means; and,
(b) said one end being pivotally secured to said frame.
7. The exerciser of claim 6, wherein:
(a) said second shaft means extends from opposite sides of said frame parallel to said first mentioned shaft;
(b) the piston of each of said cylinder and piston means having a bushing at the distal end thereof; and,
(c) each of said bushings being pivotally mounted to said second shaft means so that said pistons pivot in spaced parallel planes.
8. The exerciser of claim 7, wherein:
(a) the cylinder of each of said cylinder and piston means including an apertured ear at the distal end thereof; and,
(b) a bolt being secured to said clamp means and being positioned in the aperture of each of said ears for pivotally securing said cylinders to said clamp means.
9. The exerciser of claim 1, wherein:
(a) said second resistance means includes an adjustment for controlling the ease of rotation of said flywheel means.
10. The exerciser of claim 1, wherein:
(a) each of said first resistance means selectively engaged with the lower end portion of the associated handle bar means for permitting each handle bar means to be set at a selected resistance setting and whereby the resistance settings need not be uniform.

* * * * *